US005454312A

United States Patent [19]

Helmstaedter et al.

[11] Patent Number: 5,454,312

[45] Date of Patent: Oct. 3, 1995

[54] ROTARY SHEET-FED PRINTING PRESS FOR RECTO AND VERSO PRINTING HAVING AN IMPRESSION CYLINDER DOUBLE THE DIAMETER OF A BLANKET CYLINDER AND SERVING AS A STORAGE DRUM

[75] Inventors: Karl-Heinz Helmstaedter, Sinsheim; Nikolaus Spiegel, Walldorf, both of Germany

[73] Assignee: Heidelberger Druckmaschinen AG, Heidelberg, Germany

[21] Appl. No.: 328,072

[22] Filed: Oct. 24, 1994

[30] Foreign Application Priority Data

Oct. 22, 1993 [DE] Germany ..... 43 36 047.5

[51] Int. Cl.[6] ..... B41F 5/02

[52] U.S. Cl. ..... 101/230; 101/409; 271/276; 271/277

[58] Field of Search ..... 101/229, 230, 101/231, 231, 216, 409, 410; 271/112, 260, 276, 277

[56] References Cited

U.S. PATENT DOCUMENTS

| | | | |
|---|---|---|---|
| 2,395,444 | 2/1946 | Belluche . | |
| 3,986,455 | 10/1976 | Jeschke | 101/409 |
| 3,992,993 | 11/1976 | Kuhn et al. . | |
| 4,127,265 | 11/1978 | Wirz et al. | 271/260 |
| 4,930,414 | 6/1990 | Wirz | 101/230 |
| 5,063,843 | 11/1991 | Becker | 101/230 |
| 5,186,107 | 2/1993 | Wieland | 271/276 |

FOREIGN PATENT DOCUMENTS

| | | |
|---|---|---|
| 0452721 | 10/1991 | European Pat. Off. . |
| 0527424 | 2/1993 | European Pat. Off. . |
| 3-12517 | 3/1991 | Japan . |
| 1467602 | 3/1977 | United Kingdom . |

*Primary Examiner*—Eugene H. Eickholt
*Attorney, Agent, or Firm*—Herbert L. Lerner; Laurence A. Greenberg

[57] ABSTRACT

A rotary sheet-fed printing press for recto and verso printing has a turning drum disposed between impression cylinders having double the diameter of a conventional blanket cylinder, wherein a sheet gripped at a leading edge thereof by grippers of a first one of the impression cylinders is gripped at a trailing edge thereof by grippers of the turning drum upon transfer of the sheet to the turning drum. In the turning drum, suction nozzles are provided which suck the sheet, guided on the one impression cylinder, towards the turning drum in the vicinity of the trailing edge of the sheet and, in so doing, smooth it diagonally and peripherally on the circumference of the one impression cylinder, before the grippers of the turning drum which grip the sheet by the trailing edge thereof are closed, and the grippers of the one impression cylinder which grip the sheet by the leading edge thereof are opened.

3 Claims, 3 Drawing Sheets

ROTARY SHEET-FED PRINTING PRESS FOR RECTO AND VERSO PRINTING HAVING AN IMPRESSION CYLINDER DOUBLE THE DIAMETER OF A BLANKET CYLINDER AND SERVING AS A STORAGE DRUM

SPECIFICATION

The invention relates to a rotary sheet-fed printing press for first-form and perfector or recto and verso printing, having a turning drum between impression cylinders of two successive printing units and, more particularly, to such a printing press wherein the impression cylinders have double the diameter of a blanket cylinder, one of the impression cylinders being disposed upstream of the other impression cylinder in a sheet travel direction through the printing press, the one impression cylinder having grippers thereon for gripping a leading edge of a sheet travelling in the sheet travel direction, the turning drum having double the diameter of the blanket cylinder and having grippers thereon for gripping the sheet at a trailing edge thereof so as to transfer the sheet to the turning cylinder before the grippers of the one impression cylinder gripping the sheet at the leading edge thereof are opened.

Such a rotary sheet-fed printing press has become known heretofore from published Japanese Patent Document SHO 3-12517. In this publication, the sheet is described as being gripped at the front edge thereof by clamping grippers, which are disposed movably on an impression cylinder and controlled in accordance with the operating cycle of the press, and is drawn over the entire length thereof past the transfer point, at which the sheet is transferred or released to the turning drum; tongs-type grippers movably disposed on the turning drum engage the sheet at the trailing edge thereof, so that the sheet, with the trailing edge thereof leading, is then wrapped around the turning drum. In-register sheet transfer presents very difficult problems, because smoothing of the sheet on the printing cylinder which functions as a storage drum would be required. With conventional equipment, however, this is unattainable because of the required means for adjusting the format on the impression cylinder.

From published German Patent Document DE 30 50 295, an arrangement of suction nozzles which are movable in the circumferential and axial directions of a simple transfer drum, and which apply suction to a sheet in a trailing region thereof for the purpose of effecting a lateral and peripheral smoothing of the sheet have become known heretofore. From the published German Patent Document DE 24 52 096, rotary suckers or suction devices with an asymmetrically disposed suction opening are provided for the same purpose in a transfer drum, so that a rotary movement of the rotary suction devices leads to lateral and circumferential smoothing of the sheet to which suction has been applied in the vicinity of the trailing edge thereof, and which has been held by the leading edge thereof in a gripper system. Also disclosed in this published document are a plurality of rotary suction devices disposed side-by-side in a row transversely to the longitudinal center of the press and having a rotary angle which increases outwardly from the longitudinal center of the press. Comparable arrangements are also described in published German Patent Document DE 30 36 790 C2.

It is accordingly an object of the invention to provide a rotary sheet-fed printing press for recto and verso printing having two successive printing units with a respective impression cylinder double the diameter of a blanket cylinder and serving as a storage drum, and a turning drum between the respective impression cylinders of the two successive printing units, by means of which in-register sheet transfer from the impression cylinder of the printing unit located upstream of the other printing unit in a sheet travel direction to the turning drum during sheet turning is achieved.

With the foregoing and other objects in view, there is provided, in accordance with the invention, a rotary sheet-fed printing press for first-form and perfector or recto and verso printing, having a turning drum between impression cylinders of two successive printing units, the impression cylinders having double the diameter of a respective blanket cylinder in cooperative engagement with the impression cylinders, one of the impression cylinders being disposed upstream of the other impression cylinder in a sheet travel direction through the printing press, the one impression cylinder having grippers thereon for gripping a leading edge of a sheet travelling in the sheet travel direction, the turning drum having double the diameter of the blanket cylinder and having grippers thereon for gripping the sheet at a trailing edge thereof so as to transfer the sheet to the turning cylinder before the grippers of the one impression cylinder gripping the sheet at the leading edge thereof are opened, comprising suction nozzles mounted on the turning drum for diagonally and peripherally tensioning the sheet on the one impression cylinder which serves as a storage drum, the suction nozzles being actuatable for sucking the sheet towards the circumference of the turning drum in vicinity of the trailing edge of the sheet so as to smooth the sheet on the surface of the one impression cylinder diagonally and peripherally before the grippers of the turning drum close so as to grip the sheet by the trailing edge thereof, and the grippers of the one impression cylinder gripping the sheet by the leading edge thereof open.

In accordance with another feature of the invention, the rotary sheet-fed printing press includes rotary suction devices, respectively, formed with a suction opening disposed asymmetrically to a rotary axis of the respective rotary suction devices and disposed in a rear region of a sheet lay of the one impression cylinder.

In accordance with a concomitant feature of the invention, the rotary sheet-fed printing press includes, in the rear lay region of the sheet on the one impression cylinder, a plurality of the rotary suction devices disposed side-by-side and spaced apart on the turning drum and extending transversely to a longitudinal center of the press.

By means of the suction nozzles on the turning drum, the trailing end of the sheet, moving past the transfer point to the turning drum, guided on the one impression cylinder, and gripped by the front edge thereof in the clamping grippers of the one impression cylinder, is subjected to suction, the suction forces being effective both counter to the direction of revolution of the one impression cylinder peripherally, as well as diagonally to the side, so that the sheet is smoothed both circumferentially and laterally, thereby resting flat and smoothly against the circumferential surface of the one impression cylinder when the tongs-type grippers of the turning drum grip the trailing edge of the sheet. Because the clamping grippers of the one impression cylinder securely grip the sheet by the leading edge thereof, a slight relative motion between the suction nozzles and the sheet sucked in the trailing region thereof against the turning drum can possibly occur in the course of this smoothing motion. At the same time, as a result of the suction nozzles provided according to the invention, greater security is achieved in gripping the sheet at the trailing edge thereof by the tongs-type grippers of the turning drum, because the suction devices on the turning drum always move the trailing edge of the sheet to a precise position in which it is gripped by the tongs-type grippers of the turning drum.

For putting the concept of the invention into actual practice, rotary suction devices formed with a respective suction opening asymmetrical to the rotary axis of the respective suction devices and being of the type described, for example, in German Patent 24 52 096 are suitable. Other heretofore known devices, for example, as in German Patent 30 36 790, are also suitable, however.

In a further feature of the invention, the rotary suction devices disposed on the turning drum in the vicinity of the tongs-type grippers may be disposed side-by-side and spaced apart, and may extend transversely to the longitudinal center of the press, and the rotary suction devices have a respective rotary angle which increases outwardly from the press center, for effecting a smoothing of the sheets.

Finally, it should be emphasized that the characteristic features of the invention lead to the same advantages in regard to sheet smoothing if the turning drum is used only as a transfer drum in recto or first-form printing.

Other features which are considered as characteristic for the invention are set forth in the appended claims.

Although the invention is illustrated and described herein as embodied in a rotary sheet-fed printing press for recto and verso printing having an impression cylinder double the diameter of a blanket cylinder and serving as a storage drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
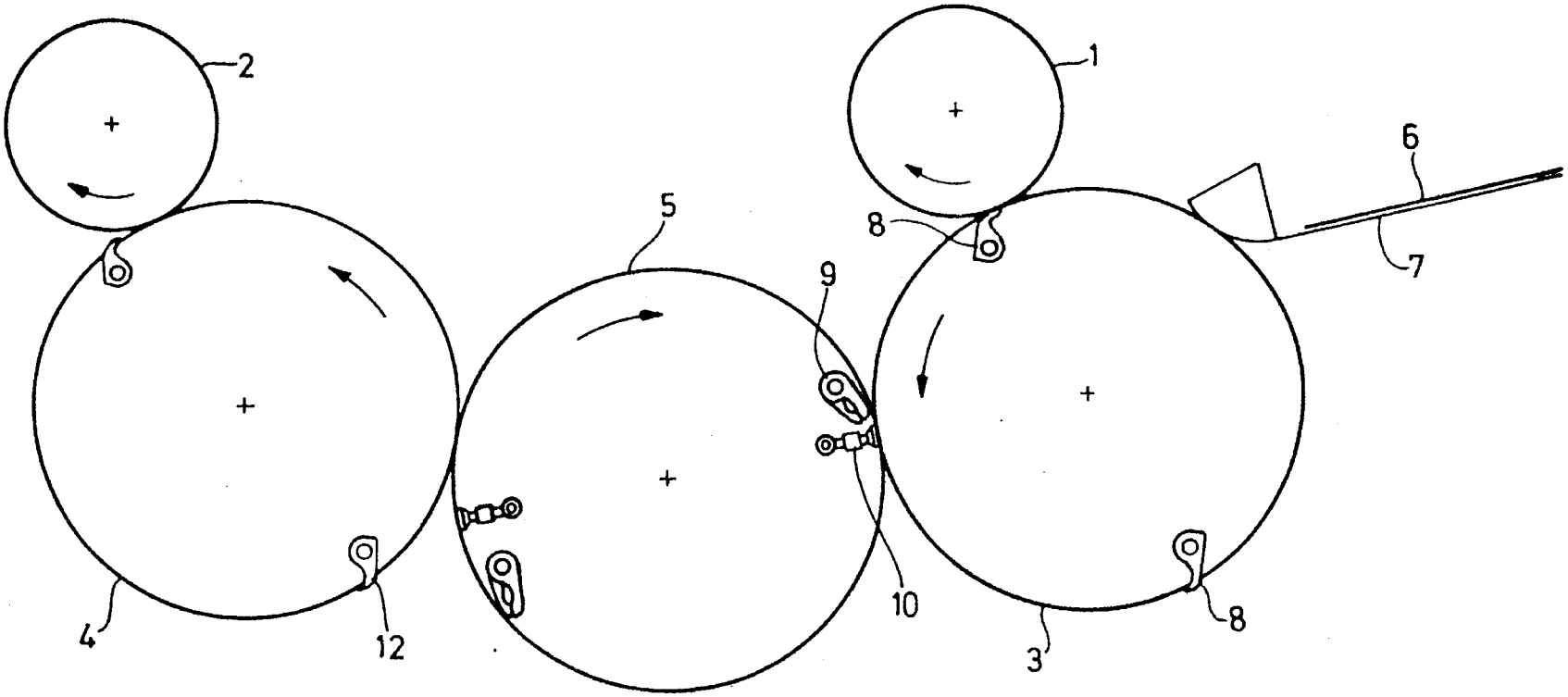
FIG. 1 is a fragmentary, diagrammatic side elevational view of a rotary sheet-fed printing press with impression cylinders and a turning drum double the diameter of associated blanket cylinders, the turning drum being located between the impression cylinders.

Referring now to the drawings and, first, particularly to FIG. 1 thereof, there are shown therein rubber blanket cylinders 1 and 2 of two successive printing units of a printing press, each of the blanket cylinders 1 and 2 having a given standard or conventional diameter, a so-called single diameter, resulting in a circumference of the blanket cylinder which is of such length as to accommodate a single sheet thereon. Impression cylinders 3 and 4 cooperating with the rubber blanket cylinders 1 and 2 have, in contrast therewith, twice the diameter of the blanket cylinders, respectively, a so-called double diameter. A turning drum 5, likewise with a double diameter is located between the two double-diameter impression cylinders 3 and 4 of the two successive printing units. Sheets 6 to be printed are gripped at respective leading edges thereof successively in a sheet feeder 7 by a clamping gripper system 8 of the impression cylinder 3 disposed upstream from the other impression cylinder 4 in a sheet travel direction through the press, i.e., from the right-hand side to the left-hand side of FIG. 1, transported in the sheet travel direction through a printing nip of the preceding printing unit having the impression cylinder 3, and delivered to the succeeding printing unit having the impression cylinder 4 via the turning drum 5 which, in recto or first-form printing is used as a transfer drum. In verso or perfector printing, the sheet 6 to be printed is turned over by the turning drum 5 and delivered, with its trailing edge leading, to the succeeding printing unit having the impression cylinder 4.

Figure 2:
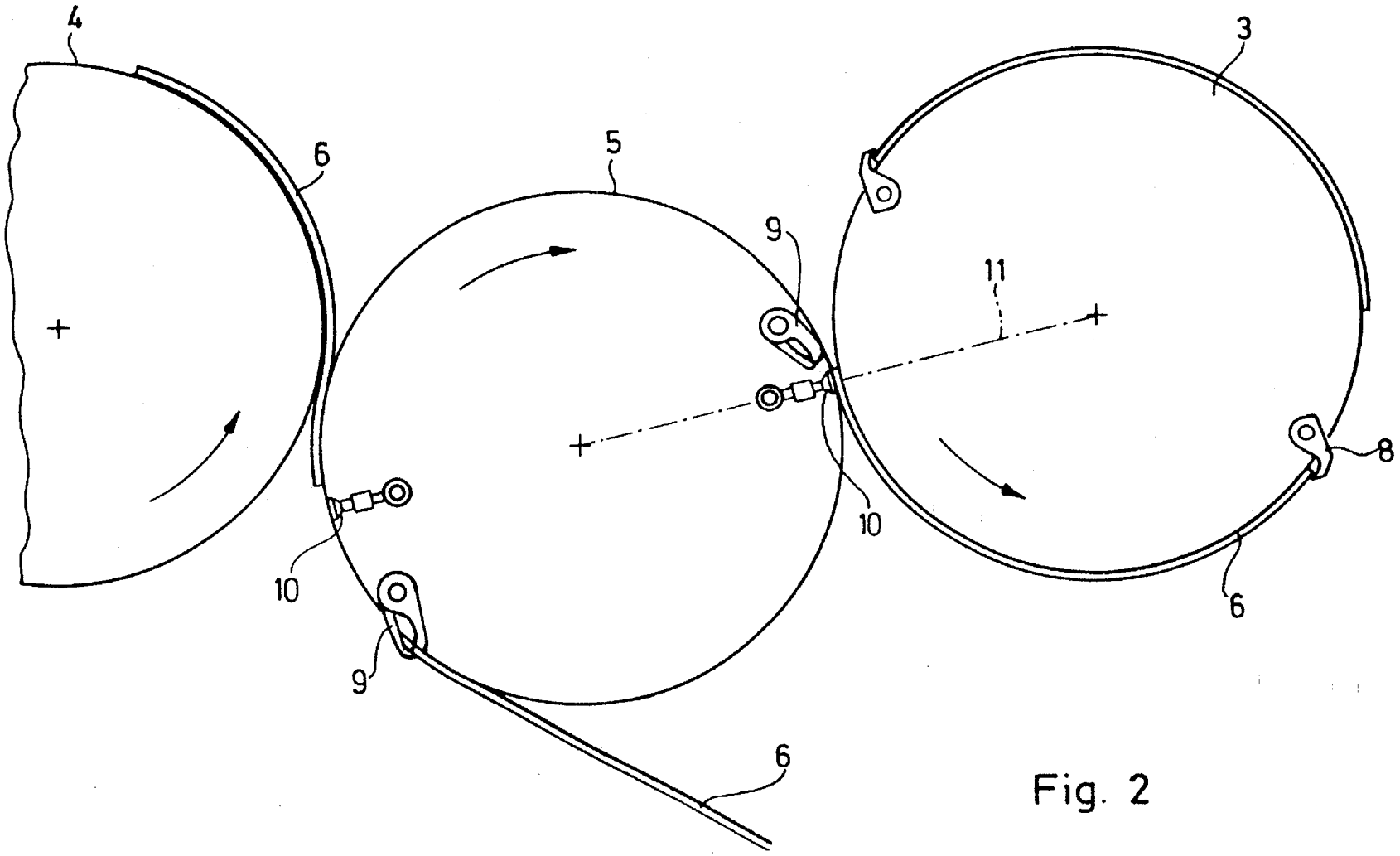
FIG. 2 is a slightly enlarged view of FIG. 1 providing a clearer illustration of sheet guidance at the turning drum.

According to the invention, the turning drum 5 has suction nozzles 10 disposed in the vicinity of the gripper system 9 thereof; as shown in FIG. 2, the suction nozzles 10 apply suction to the sheet 6 at the trailing edge thereof towards the outer cylindrical surface or circumference of the turning drum 5, as the sheet is moved past the transfer point in verso or perfector printing, and in so doing execute a motion transverse to the longitudinal direction of the press, so that the sheet 6, gripped at the leading edge thereof by the gripper system 8 of the impression cylinder 3 of the preceding printing unit in the sheet travel direction, rests flat over the entire length thereof against the outer cylindrical surface or circumference of the impression cylinder 3 and, at the instant of transfer, with the trailing edge thereof, assumes an exactly defined position wherein the gripper system 9 of the turning drum 5 grips the trailing edge of the sheet. As further shown in FIG. 2, the transfer point is defined by a straight line 11 connecting the axes of rotation of the impression cylinder 3 and the turning drum 5. After the leading edge of the sheet 6 has been released by the gripper system 8 of the impression cylinder 3 and the suction nozzles 10 have been shut off, the then turned or inverted sheet is delivered, with the trailing edge thereof leading, to the gripper system 12 (FIG. 1) of the impression cylinder 4.

Figure 3:
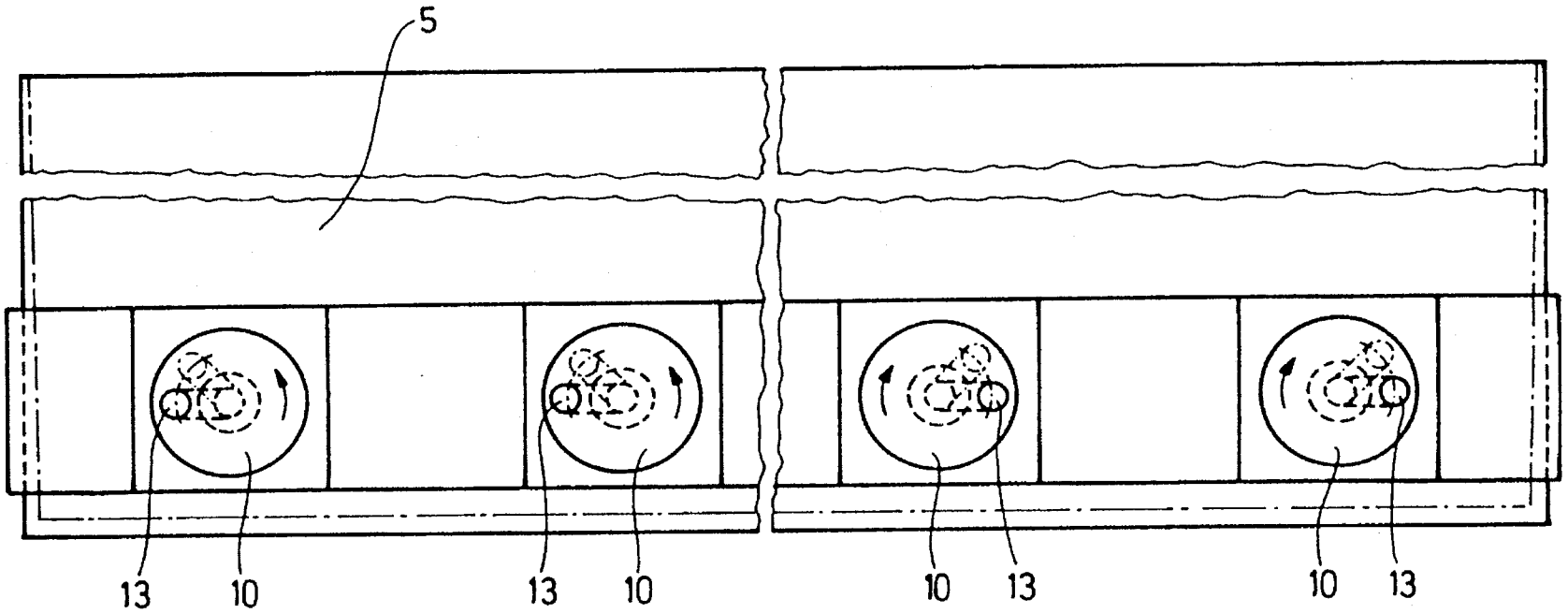
FIG. 3 is a top plan view of the turning drum, and showing suction nozzles disposed side-by-side at the turning drum.

FIG. 3 schematically shows that the suction nozzles 10 may be disposed side by side and spaced apart transversely to the longitudinal center of the press; asymmetrically disposed suction openings 13, in the suction-applying phase, execute a rotary motion with a rotary angle which increases outwardly from the longitudinal center of the press, so as thereby to achieve a lateral tightening or tautening of the sheet in addition to the circumferential tightening or tautening of the sheet.

We claim:

1. Rotary sheet-fed printing press for first-form and perfector or recto and verso printing, having a turning drum between impression cylinders of two successive printing units, the impression cylinders having double the diameter of a respective blanket cylinder in cooperative engagement with the impression cylinders, one of the impression cylinders being disposed upstream of the other impression cylinder in a sheet travel direction through the printing press, the one impression cylinder having grippers thereon for gripping a leading edge of a sheet travelling in the sheet travel direction, the turning drum having double the diameter of the blanket cylinder and having grippers thereon for gripping the sheet at a trailing edge thereof so as to transfer the sheet to the turning drum before the grippers of the one impression cylinder gripping the sheet at the leading edge thereof are opened, comprising suction nozzles mounted on the turning drum for diagonally and peripherally tensioning the sheet on the one impression cylinder which serves as a storage drum, said suction nozzles being actuatable for sucking the sheet towards the circumference of the turning drum in vicinity of the trailing edge of the sheet so as to smooth the sheet on the surface of the one impression cylinder diagonally and peripherally before the grippers of the turning drum close so as to grip the sheet by the trailing edge thereof, and the grippers of the one impression cylinder gripping the sheet by the leading edge thereof open.

2. Rotary sheet-fed printing press according to claim 1, including rotary suction devices, respectively, formed with a suction opening disposed asymmetrically to a rotary axis of the respective rotary suction devices and disposed in a rear region of a sheet lay of the one impression cylinder.

3. Rotary sheet-fed printing press according to claim 2, wherein, in the rear lay region of the sheet on the one impression cylinder, a plurality of said rotary suction devices are disposed side-by-side and spaced apart on the turning drum and extend transversely to a longitudinal center of the press.

* * * * *